US005308102A

United States Patent [19]

Bildner

[11] Patent Number: 5,308,102

[45] Date of Patent: May 3, 1994

[54] ELASTIC LOCKING DEVICE, ESPECIALLY A HEEL PORTION OF A SAFETY SKI BINDING

[76] Inventor: Heinz H. Bildner, Am Anger 18, 8221 Seebruck/Arlaching, Fed. Rep. of Germany

[21] Appl. No.: 946,460

[22] PCT Filed: Feb. 6, 1992

[86] PCT No.: PCT/EP92/00265

§ 371 Date: Nov. 17, 1992

§ 102(e) Date: Nov. 17, 1992

[87] PCT Pub. No.: WO92/17252

PCT Pub. Date: Oct. 15, 1992

[30] Foreign Application Priority Data

Mar. 27, 1991 [DE] Fed. Rep. of Germany ..... 4110163

[51] Int. Cl.[5] ..... A63C 9/084

[52] U.S. Cl. ..... 280/612; 280/632

[58] Field of Search ..... 280/612, 631, 632, 634, 280/DIG. 13

[56] References Cited

U.S. PATENT DOCUMENTS 4,159,124 6/1979 Salomon ..... 280/612
4,482,168 11/1984 Oberleitner ..... 280/612
4,494,767 1/1985 Campillo et al. ..... 280/612
4,563,021 1/1986 Klubitschko ..... 280/612
5,085,453 2/1992 Bildner ..... 280/612

FOREIGN PATENT DOCUMENTS 2418655 11/1979 France ..... 280/612

*Primary Examiner*—Brian L. Johnson
*Attorney, Agent, or Firm*—Keck, Mahin & Cate

[57] ABSTRACT

A retainer member (26) is guided for displacement at a housing (24) which is adapted to be fastened to a ski (10), the retainer member being biased by a spring assembly (70) in the direction toward a ski boot (12). The housing (24) contains a support member (40) kept in an inoperative position, in which it forms a thrust bearing for the spring assembly (70), by a locking member (50) as long as the latter is in locking position. Normally, a shoulder (48) formed at a pawl (46) which is pivotable about a transverse pivot axis (44) presses against the locking member (50). An electromagnet (60) is associated with the pawl (46) and becomes energized when the retainer member (26) or a hold-down member (30) supported on the same runs the risk of becoming overloaded. Upon excitation of the electromagnet (60), its armature (62) hits against the pawl (46) which then releases the locking member (50). Thereupon the support member (40) moves into its retracted position so that the retainer member (26) and the hold-down member (30) both are relieved of the pressure of the spring assembly (70), thus releasing the ski boot (12).

10 Claims, 7 Drawing Sheets

ELASTIC LOCKING DEVICE, ESPECIALLY A HEEL PORTION OF A SAFETY SKI BINDING

FIELD OF THE INVENTION

The invention relates to an elastic locking device, especially a heel portion of a safety ski binding, comprising

- a housing for fastening to one of two objects to be locked together, especially a ski,
- a retainer member movably guided at the housing in a direction of contact pressure against the second of the two objects to be locked together, especially a ski boot,
- a support member which is movable with respect to the housing, contrary to the contact pressure direction, from an inoperative position into a retracted position,
- a spring assembly which rests on the support member and loads the retainer member in the contact pressure direction,
- at least one locking member, normally in a locking position in which it keeps the support member in the inoperative position, and movable into a passing position in which it permits movement of the support member into the retracted position,
- a pawl which normally keeps the locking member in locking position, and
- an electromagnet including an armature which is movable along a magnet axis against the pawl to render it ineffective, thus permitting movement of the support member into the retracted position, when a power circuit containing the electromagnet is in a predetermined switching state.

BACKGROUND OF THE INVENTION

Locking devices of this kind designed as the heel portion of a safety ski binding known from DE 38 08 643 C1. They comprise a housing which is fastened to the ski and at which a retainer member biased in forward direction by a spring assembly is guided so as to be displaceable forwardly in the longitudinal direction of the ski. In a front end area of the retainer member, a hold-down member is supported for pivoting about a transverse axis. The spring assembly which biases the retainer member in forward direction is designed such that it also loads the hold-down member in the sense of forward downward turning. Upon fastening of a ski boot, the rear sole portion thereof is pressed forward by a lower projection formed at the hold-down member, while a hook-shaped projection provided further upwards at the hold-down member presses the rear sole portion downwardly. Behind the hold-down member in the housing of the locking device there is a rod which is guided for longitudinal displacement and biased in forward direction so that its front end rests against a back surface of the hold-down member. Further backwards, the rod is formed with a cam, and a switch in the power circuit of an electromagnet is associated with the cam for unlocking the locking device. In case of a fall towards the front, the hold-down member is pivoted upwards and backwards by the rear sole portion which moves in upward direction so that the switch is actuated by way of the rod and its cam, whereby the electromagnet is supplied with power. Consequently, an armature of the magnet is pulled forward, hitting against the rear end of a longitudinally displaceable pawl which is biased to the rear and has a rearwardly tapering conical portion engaging between two roller bodies, acting as locking members, which it normally maintains in a locking position in which they in turn retain a support member in an inoperative position in the housing. As soon as the pawl is propelled forward by the armature, the two locking members leave their locking position, thereby releasing the support member. The support member, on which the rear end of the spring assembly rests, moves backwards under the pressure of the spring assembly into a retracted position. In this manner the bias of the spring assembly is reduced so that the retainer member and the hold-down member supported on the same both move backwards, releasing the rear sole portion of the ski boot.

This known locking device works perfectly if the dimensions of the electromagnet and its current supply are of such magnitude that its armature will hit the rear end of the pawl with considerable kinetic energy, thus overcoming the friction which is opposed to the required forwardly directed movement of the pawl clamped between the two locking members. This friction depends on the bias of the spring assembly converted by the hold-down member into forwardly and downwardly directed forces acting on the rear sole portion. The armature must have a considerable inert mass in order for the kinetic energy, needed for overcoming the friction, to be built up in the armature. If this inert mass is to be prevented from inadvertently releasing the safety ski binding under certain skiing conditions, the armature must be biased rearwardly by its own spring and, as a consequence, the power requirement of the electromagnet becomes even greater.

SUMMARY OF THE INVENTION

It is the object of the invention to improve an elastic locking device furnished with an electromagnet in such manner that it will release with great accuracy and at little power consumption when certain loading conditions occur.

This object is met, in accordance with the invention, by an elastic locking device of the kind described initially in which the pawl is supported for pivoting movement about a pivot axis which extends transversely of and spaced from the magnet axis, and the pawl comprises a shoulder which is spaced from the pivot axis and normally presses against the locking member and, together with the magnet axis, defines an angle which is within the self-locking range.

It has been found that only relatively little frictional resistance must be overcome when the pawl is pivoted, an action which reliably causes its shoulder to slide off the locking member, a light stroke of the armature against the pawl being sufficient.

Thus the armature need only comprise a small inert mass so that it requires only a relatively weak magnetic field to be propelled, and that can be generated with but little current consumption.

The pivot axis conveniently is disposed above the locking member so that the pawl tends to swing into its normal position under the influence of its own weight, in which position it keeps the locking member in locking state. In addition, or instead, the pawl may be biased elastically in the sense of being turned into normal position.

In a preferred embodiment of the invention, the pawl is supported on the support member and movable, upon release of the locking member, together with the locking member and the support member, contrary to the contact pressure direction, this being toward the rear in the case of a heel portion of a safety ski binding.

Inadvertent release, especially with a heel portion of a safety ski binding can be prevented with great reliability if the electromagnet is arranged between the retainer member and the pawl, if the magnet axis extends parallel to the contact pressure direction, and if the armature is movable contrary to the direction of contact pressure, in the predetermined switching state. A heel portion of a safety ski binding characterized by these features is largely unsusceptible of sudden retardations, as yet harmless to the skier, as may occur for instance in a jump or when quickly passing through a depression.

In order to meet the object recited above, a locking device of the kind specified initially may be modified, in accordance with the invention, in that

- a hold-down member for the second one of the objects to be locked together, especially a ski boot, is supported at the retainer member for movement between a hold-down position and a release position,
- the spring assembly biases the hold-down member in the direction of its hold-down position,
- the retainer member has an abutment surface for the second object, especially a ski boot, and
- a switch each in the electric circuit of the electromagnet is associated with the retainer member and the hold-down member.

In this manner the hold-down member need only apply hold-down forces and, therefore, will actuate the associated switch only in case of a forward fall, for example. The forwardly directed forces which are needed, for instance, to press a ski boot against a front binding of conventional construction are exerted directly at the retainer member so that, as a result, the retainer member will respond to twist falls during which the ski boot is pressed backwards by the front ski binding portion. The movement this involves of the retainer member is monitored by the associated switch, irrespective of the switch for the hold-down member. These two switches can be adjusted in consideration of the admissible loads under different loading conditions, such as with forward falls, on the one hand, and falls in rotation, on the other hand, so that the ski boot will be released reliably and with little power consumption by the electromagnet when either of these types of falls occurs, including a combination thereof, the so-called diagonal fall.

Conveniently, the two switches are connected in parallel in a common circuit. Furthermore, it is convenient if they are both connected in series with a common timer. However, separate timers also may be provided for each of the two switches, for example if the reaction is to be quicker or slower under loads which occur with a frontal fall than with loads which may result during a twist fall.

Preferably, one each of two rods disposed at either side of a longitudinal median plane of the locking device is associated with the retainer member and the hold-down member, respectively, for actuating the corresponding switch. This embodiment of the invention preferably is developed further in that a cam is arranged for displacement on at least one of the rods for actuating the corresponding switch and is biased by a spring in the direction of a shoulder with which the rod is formed, a fixed stop in the housing preventing the cam from being displaced beyond the corresponding switch.

BRIEF DESCRIPTION OF THE DRAWINGS

An embodiment of the invention will be described in greater detail below with reference to the diagrammatic drawings, in which.

DETAILED DESCRIPTION OF THE PREFERRED EMBODIMENTS

Figure 1:
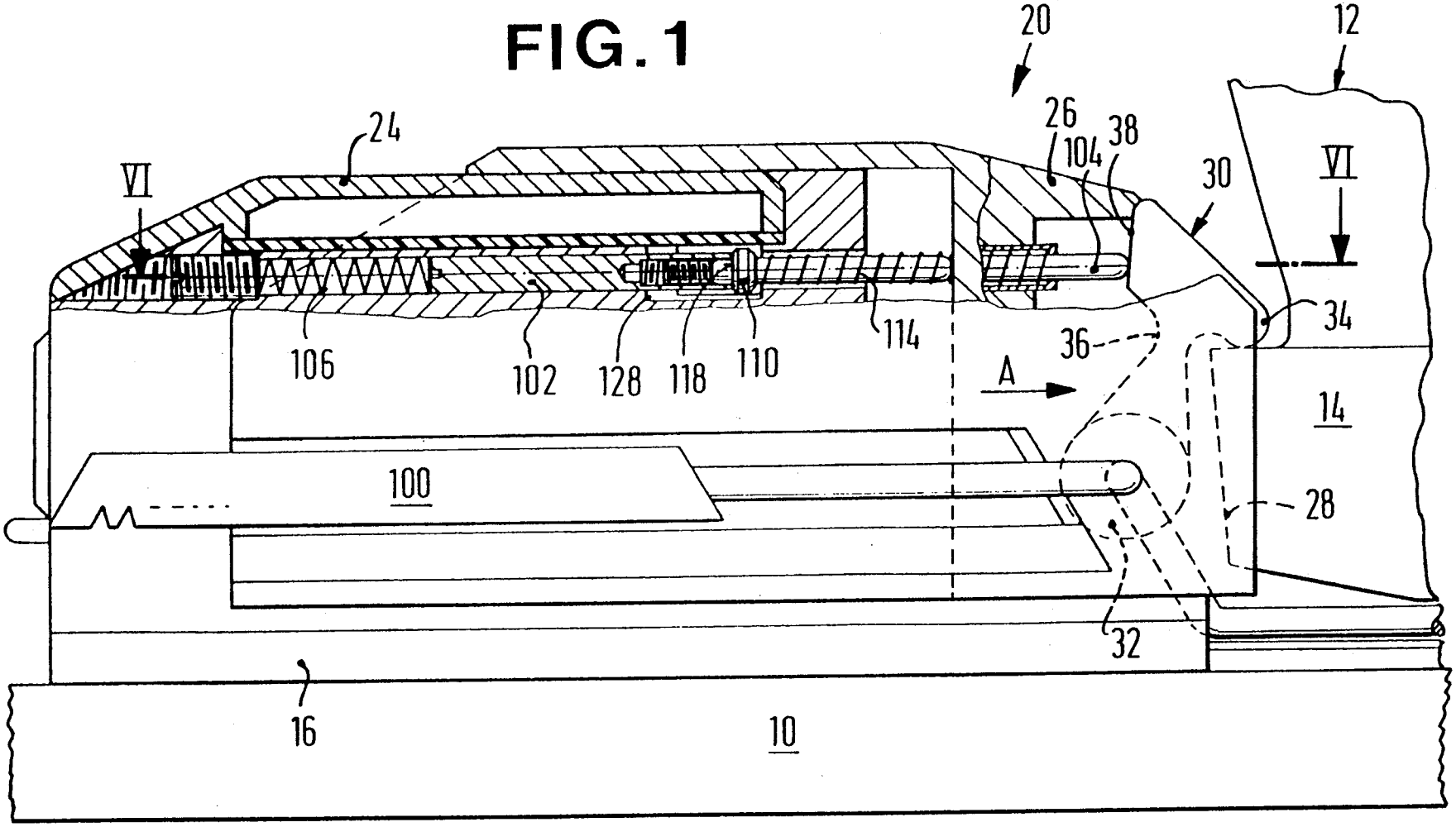
FIG. 1 shows an elastic locking device according to the invention, embodied by a heel portion of a safety ski binding, in a side elevational view which is shown in part as the vertical longitudinal sectional view I—I in FIG. 6.

The drawings show a central part of a ski 10 with a ski boot 12 of which only a rear sole portion 14 is of interest in the present context. A rail 16 which has a profile in the form of a C on its back that is symmetrical with respect to the longitudinal median plane 18 of the ski is secured on the ski 10. An elastic locking device 20 is held in the rail 16. In the embodiment illustrated it serves as the heel portion of a safety ski binding and its object is to press the rear sole portion 14 forwardly against a front binding (not shown) of conventional structure and also downwardly and, if there is an emergency, to release this rear sole portion 14 rearwardly, in case of a twist fall, and upwardly, in case of a fall toward the front.

In general, the elastic locking device 20 is designed symmetrically with respect to the longitudinal median plane 18 and has a base plate 22 which is guided for longitudinal displacement in the rail 16 and firmly positioned on the ski 10 in the area of the front binding mentioned by means of a detent device of known structure (not shown). A housing 24 is secured on the base plate 22, and a retainer member 26 is guided for displacement in longitudinal direction of the ski in the housing, exerting a forwardly directed force on the rear sole portion 14; the direction of this force will be referred to below as the direction of contact pressure A. The front side of the retainer member 26 is formed with an abutment surface 28 for transmission of this force to the backside of the rear sole portion 14. In FIG. 1 the ski boot 12 is shown in its normal position in which its rear sole portion 14 abuts against the abutment surface 28.

Figure 2:
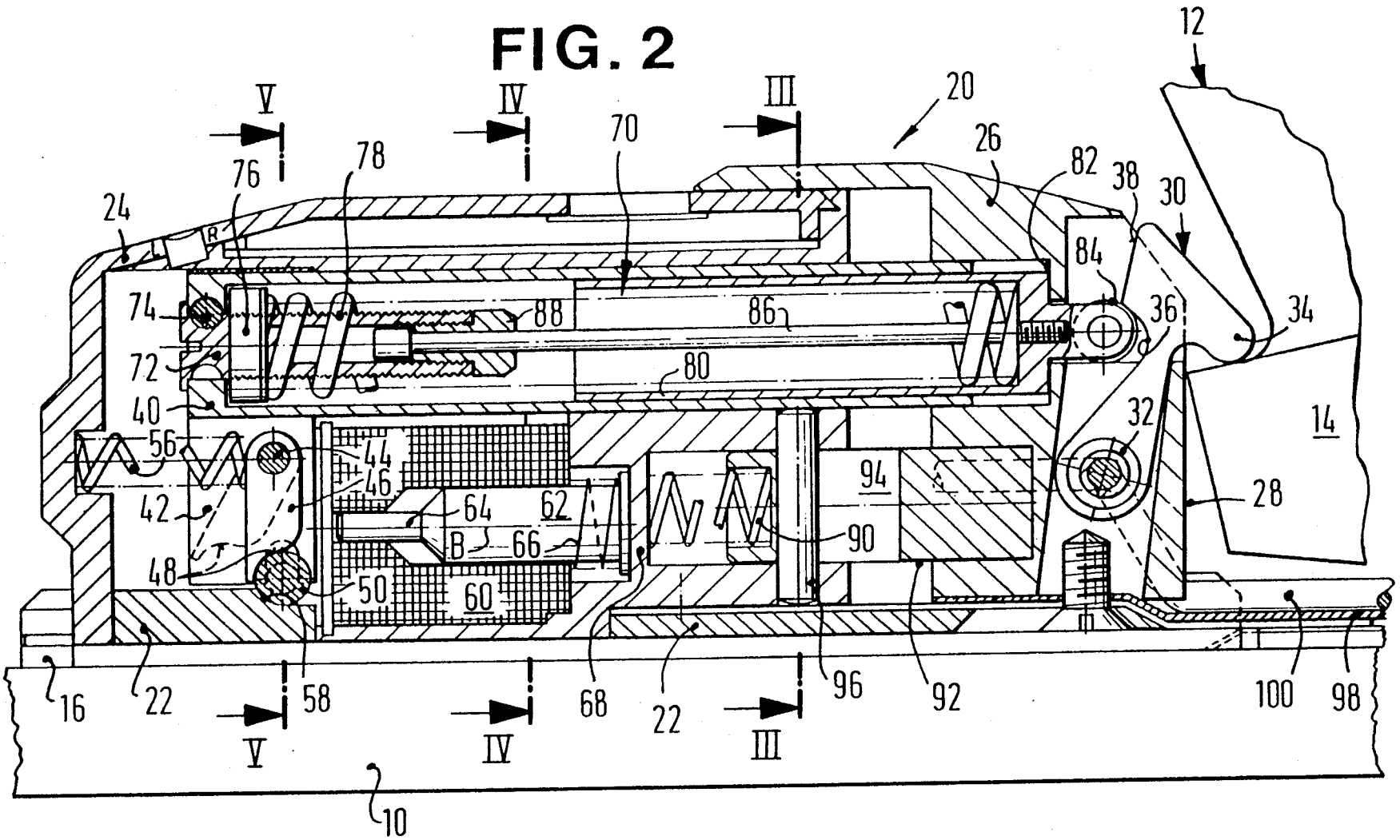
FIG. 2 shows the vertical longitudinal median sectional view II—II of FIG. 5.
Figure 3:
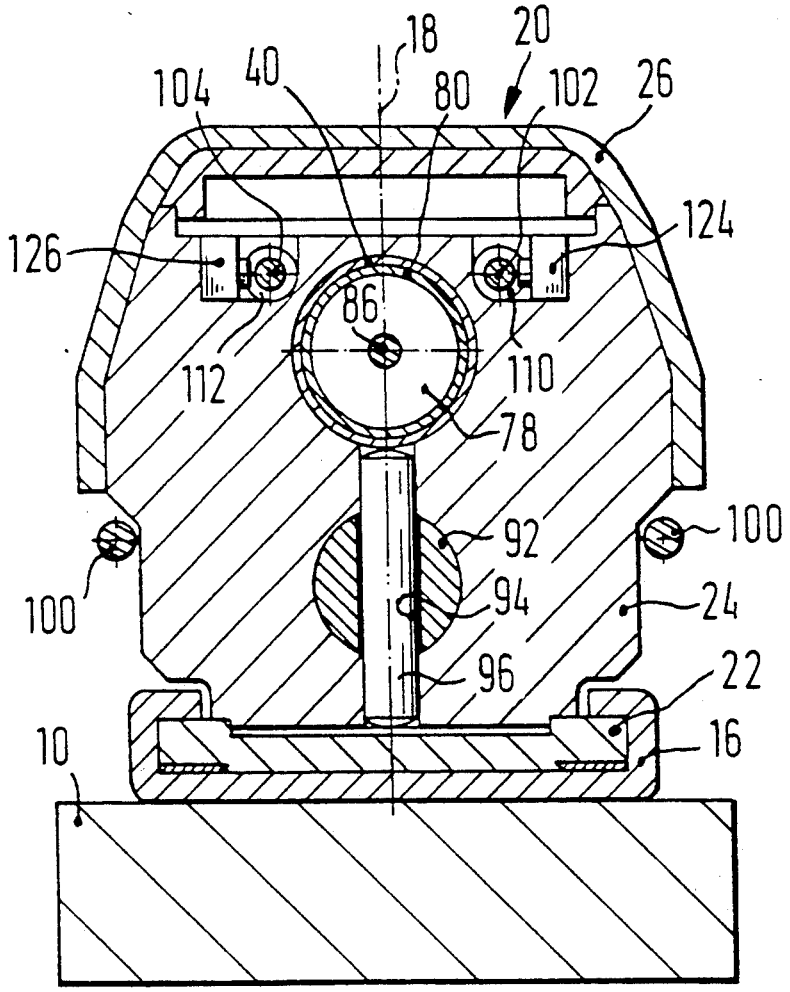
FIG. 3 shows the cross section III—III of FIG. 2.
Figure 4:
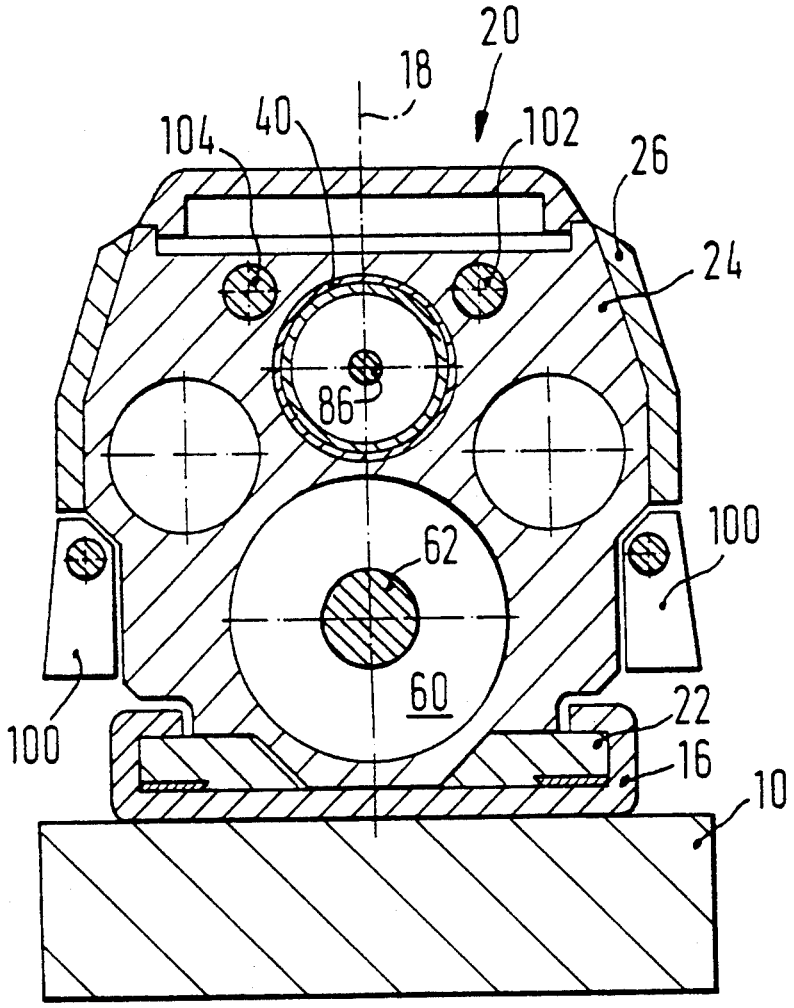
FIG. 4 shows the cross section IV—IV of FIG. 2.

FIG. 2 illustrates the ski boot during entry into the binding, it being assumed that the front binding (not shown) is closed by pressing down the tip of the ski boot.

A hold-down member 30 embodied by a lever is supported on the retainer member 26 for upward and downward swinging motion in the longitudinal median plane 18, a bearing sleeve 32 in the lower front range of the retainer member 26 serving as the fulcrum. The hold-down member 30 includes a nose 34 which presses against the upper edge of the rear sole portion 14, a concave hollow 36 remote from the nose, and a planar back surface 38 above them. The hold-down member 30 does not contact the ski boot 12, except for the nose 34 which presses down the rear sole portion 14. Therefore, the hold-down member can accommodate only upwardly directed forces which are exerted by the rear sole portion 14 on the nose 34. Any rearwardly directed forces exerted by the rear sole portion 14, on the other hand, are received directly by the retainer member 26.

A support member 40 likewise is guided for longitudinal displacement in the housing 24. The support member 40 is substantially cylindrical and is formed at its rear end with two limbs 42 oriented vertically downwards and extending in parallel with the longitudinal median plane 18. In their upper region these limbs support a pivot axis 44 in the form of a horizontally disposed transverse pin which thus extends at right angles to the vertical longitudinal median plane 18. The pivot axis 44 supports a pawl 46 for swinging movement in the longitudinal median plane 18. In the normal position, shown in solid lines in FIG. 2, the pawl extends down from the pivot axis 44 at right angles to the base plate 22.

The lower area of the pawl 46 is formed with a shoulder 48 which presses down a roller-type locking member 50 when the pawl is in normal position. The locking member 50 extends in parallel with the pivot axis 44, in other words likewise at right angles to the longitudinal median plane 18 and, at both lateral ends, it includes pins 52 which are each guided in a respective vertical slot 54 formed in the respective limb 42.

At the level of the pivot axis 44 there is a return spring 56 in the form of a helical compression spring, supported in the back at the housing 24 and constantly urging the support member 40 into the front terminal position, shown above all in FIG. 2, and referred to below as the inoperative position. The return spring 56, at the same time, subjects the pawl 46 to a small torque which returns it into the normal position after it has been swung out to the rear, as shown in discontinuous lines in FIG. 2. When in normal position, the pawl 46 keeps the locking member 50 in the position illustrated in FIGS. 2 and 5 in a part cylindrical trough 58 which rises towards the rear in the base plate 22. In this position, referred to below as the locking position, the locking member 50 together with the pawl 46 prevent any movement of the support member 40 from its inoperative position to the rear.

Inside the housing 24, in front of the limbs 42 and the pawl 46, an electromagnet 60 is disposed so that its axis, referred to below as the magnet axis B, lies in the longitudinal median plane 18 and extends parallel to the base plate 22. The electromagnet 60 comprises an armature 62 with a slender pin 64 protruding to the rear, the armature normally being held by a weak spring 66 in a front terminal position in which it abuts against a partition 68 in the housing 24.

Upon energization of the electromagnet 60, the armature 62 moves to the rear along the magnet axis B, i.e. contrary to the direction of contact pressure A, and the pin 64 hits the front side of the pawl 46 like a bullet. The shoulder 48 of the pawl is inclined forwardly and upwardly at a small angle with respect to the magnet axis B in the area in which it contacts the locking member 50. With proper choice of the materials of which the pawl 16 and the locking member 50 are made, this angle is selected such that it will be just within the range of self-locking. It may be assumed, in general, that the pawl 46 and the locking member 50 both will be made of heat-treated steel and the shoulder 48 and the locking member 50 will be finished by grinding. In that event the angle between the magnet axis B and the shoulder 48 in the area in which it touches the locking member 50 conveniently will be from about 4° to 6°. This means that moderate impact of the pin 64 on the pawl 46 will be sufficient to swing the latter to the back.

The support member 40 carries the retainer member 26 and the hold-down member 30, too, by way of a spring assembly 70 which is housed inside the housing 24 above the electromagnet 60 and partly within the retainer member 26. The spring assembly 70 comprises a screw 72 oriented forwardly in the contact pressure direction A and rotatably supported in the support member 40, with a transverse pin 74 preventing it from moving axially with respect to the support member. The screw 72 is accessible through a recess (not shown) in the housing 24 to a torque transmitting tool, such as an ordinary screw driver.

A nut 76 which is guided for longitudinal displacement in the support member 40 and secured against rotation is threaded from the front on the screw 72. The nut 76 supports the rear end of a spring 78 embodied by a helical compression spring whose front end presses against a sleeve 80 which is guided in telescopic fashion for longitudinal displacement in the support member 40 so that it normally lies against a shoulder 82 formed in the retainer member 26 and, therefore, transmits the pressure of the spring 78 acting in the contact pressure direction A directly to the retainer member 26 to a more or less great extent.

A roll 84 pressing into the concave hollow 36 of the hold-down member 30 is supported in the front terminal area of the sleeve 80 which passes forwardly through the retainer member 26. Upon fastening of the ski boot 12, the rear sole portion 14 pushes the nose 34 upwardly so that the hold-down member 30 is pivoted through a small angle in counterclockwise sense to the rear against the pressure of the spring assembly 70, as will be seen from a comparison of FIGS. 2 and 1.

For initial adjustment of the spring assembly 70, irrespective of the user, a central tie rod 86 is provided which is firmly threaded to the front end of the sleeve 80 and extends rearwardly through a plug 88 which is threaded into the screw 72 from the front. The bias of the spring 78 can be increased, to meet the user's demands, by turning the screw 72 so that the nut 76 will travel forwardly. The force thus generated in contact pressure direction A remains active only as long as the pawl 46 stays in its normal position in which it keeps the locking member 50 in locking position. This is the case as long as the electromagnet 60 remains deenergized.

Upon energization of the electromagnet 60, the armature 62 moves to the rear against the very weak resistance of its spring 66 so that the pin 64 will have its impact on the pawl 46 at a considerable distance below the pivot axis 44, thereby pivoting it rearwardly into the position indicated by discontinuous lines in FIG. 2, against the minor resistance of the friction of its shoulder 48 on the locking member 50 and the likewise very small resistance of the return spring 56. Thereupon the spring assembly 70 acts to have the locking member 50 which is guided by its pin 52 in the vertical slots 54 of the limbs 42 to be urged to the rear so that it will leave its trough 58, rolling upwards and to the back.

The locking member 50 already received a first pulse, promoting such rolling motion, from the friction of the shoulder 48 of the rearwardly pivoting pawl 46. From the beginning of an unlocking action, therefore, the locking member 50 has the right urge to turn in the right direction, namely counterclockwise, as seen in FIG. 2. For this reason the locking member 50 has to overcome only negligibly small frictional forces, essentially due to rolling friction, in order to get from its locking position into a passing position further in the back in which it can no longer prevent the support member 40 from moving out of its inoperative position into a retracted position.

The pins 52 of the locking member 50 do not leave the vertical slots 54 in the two limbs 42 of the support member 40. Thus the pawl 46 and the locking member 50 stay ready to return to the normal position of the pawl which, at the same time, is the locking position of the locking member as soon as the return spring 56 succeeds in pushing the support member 40 back to the front into its inoperative position.

With the support member 40 in the retracted position, both the retainer member 26 and the hold-down member 30 release the sole portion 14. Yet the retainer member 26 always remains loaded by an additional spring 90 which is biased only moderately, as compared to the spring 78, and exerts pressure in the contact pressure direction A on a guide bolt 92 which is fixed to the retainer member 26 and likewise extends in the direction of contact pressure A. The guide bolt is formed with a longitudinal slot 94 through which passes a vertical pin 96 fastened at the housing 24 so that the magnitude of the possible longitudinal movement of the retainer member 26 with respect to the housing 24 is limited. The spring 90 normally holds the retainer member 26 in the front terminal position as defined by the longitudinal slot 94 even if the hold-down member 30 loads the spring assembly 70 such that the sleeve 80 moves away from the shoulder 82.

Figure 5:
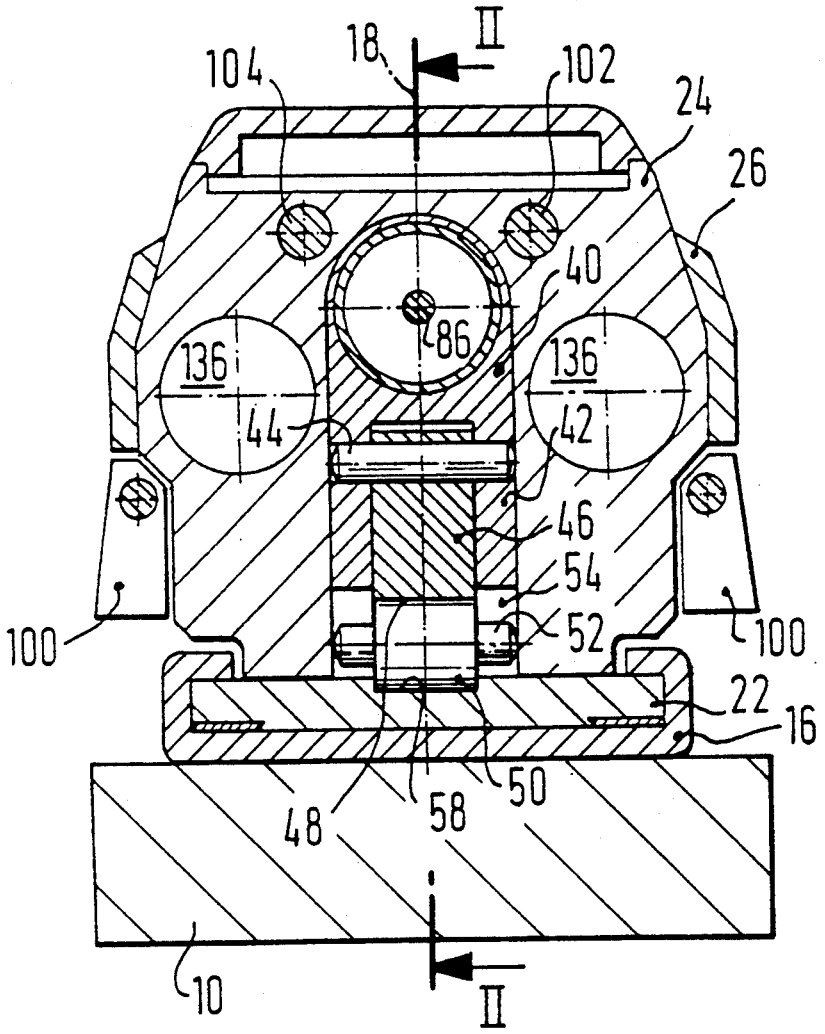
FIG. 5 shows the cross section V—V of FIG. 2.

FIGS. 1 and 2 illustrate part of a tread plate 98 which is screw connected to the retainer member 26 and has a raised tread surface (not shown) for the sole of the ski boot 12 further to the front. This tread surface takes part in all the movements of the retainer member 26 to the front and to the rear. In FIGS. 1 and 5, moreover, a ski brake 100 is indicated which is pivotably supported in the bearing sleeve 32, thereby being integrated in the elastic locking device 20. To release the locking device 20, the movements of the retainer member 26 and of the hold-down member 30 are sensed separately to accomplish that, the front ends of respective rods 102 and 104 guided for longitudinal displacement in the housing 24 and biased in contact pressure direction A by a spring 106 and 108, respectively, are supported at the retainer member 26 and the hold-down member 30. The bias of the spring 108 associated with the hold-down member 30 is approximately four times that of the bias of the spring 106 Respective cams 110 and 112 are arranged on each of the rods 102 and 104 and normally are kept in abutment against a shoulder 118 and 120, respectively, of the corresponding rod by a weak spring 114 and 116, respectively, thus being movable to the rear together with the same. Two switches 122 and 124 arranged one behind the other with a spacing in between are associated with the cam 110 on the rod 102, to be actuated mechanically by the same. On the other hand, only one switch 126, likewise operable mechanically, is associated with the cam 112 on the rod 104.

Moreover, stops 128 and 130, respectively, formed in the housing 24 are associated with each of the two cams 110 and 112 in such a manner that the cam 110 cannot be moved past the switch 124 and the cam 112 cannot be moved past the switch 126. Therefore, if the retainer member 26 should be displaced to the rear and/or the hold-down member 30 be pivoted to the rear to such an extent that the corresponding rod 102 and/or 104 with its shoulder 118 and 120, respectively, moves past the stop 128 and 130, respectively, the associated cam 110 and 112, respectively, still comes to stop in front of the corresponding switch 124 and 126, making sure that the latter remains activated. The length of both rods 102 and 104 being adjustable, the switching points are adjustable.

Figure 6:
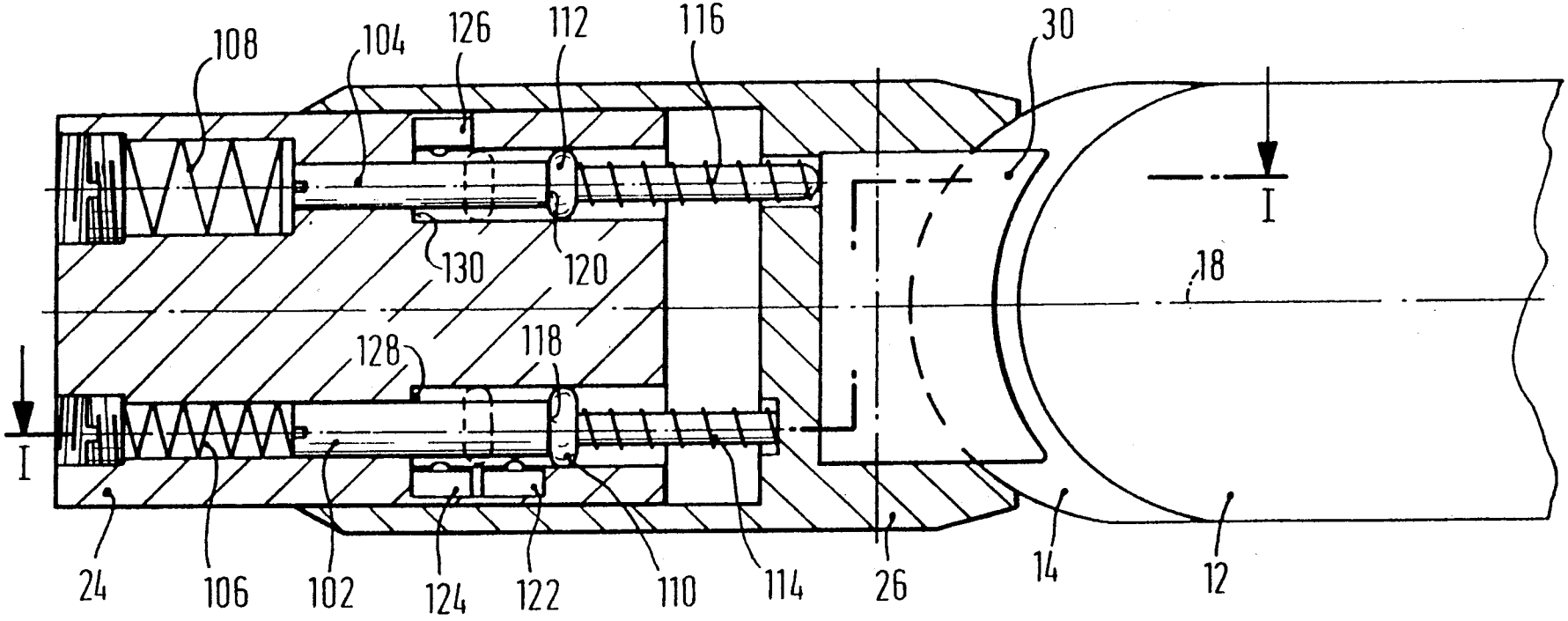
FIG. 6 shows the horizontal part sectional view VI—VI of FIG. 1.
Figure 7:
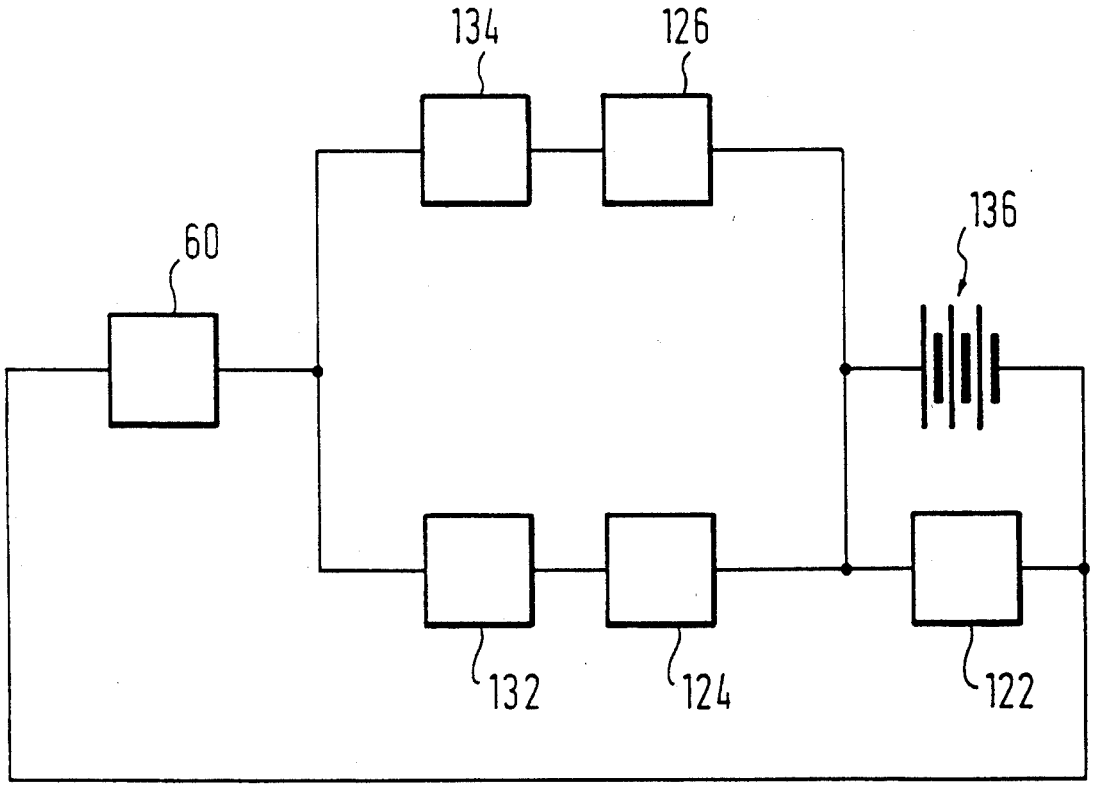
FIG. 7 is an electrical circuit diagram.

As shown in FIG. 7, each of the switches 124 and 126 is connected in series with a timer 132 and 134, respectively, which may be adjustable, and both switches 124 and 126 together with their timers 132 and 134 are connected in parallel in the electric circuit of the electromagnet 60 which circuit comprises a power source 136 constituted by a plurality of batteries. These are preferably lithium $SO_2$ batteries which remain charged for a very long time if not in use and require activation by shortcircuiting from time to time in order to remain ready for action. This function is taken care of by the switch 122 over which the associated cam 110 moves each time the ski 10 is attached. The cam 110 then usually stops in an intermediate position between the switches 122 and 124, as indicated by discontinuous lines in FIG. 6. During small forward motions of the retainer member 26 which sometimes occur during skiing, for instance when passing through depressions, the cam 110 happens to reach the switch 122 from time to time so that the batteries 136 remain activated during skiing even if a risky situation never develops.

Under rotational loading, the ski boot 12 which twists on the ski 10 urges the retainer member 26 to the rear so that the cam 110 will actuate the switch 124. The electromagnet 60 will be excited as soon as the period fixed by the timer 132, of 0.05 seconds for instance, has lapsed. The same occurs when the cam 112 has actuated the switch 126 during a forward fall and the period fixed by the timer 134, of 0.03 seconds for instance, has lapsed. In both cases the pin 64 hits the pawl 46 with such powerful impact that the pawl is swung to the rear out of its normal position, the locking member 50 reaches its passing position, and the support member 40 consequently moves into its retracted position, whereby the retainer member 26 and the hold-down member 30 are relieved of the pressure of the spring assembly, releasing the ski boot 12. As soon as that takes place, all the movable components return to their normal positions under the action of the springs 56, 78, and 90 so that nothing prevents the ski 10 from being attached once more.

What is claimed is:

1. An elastic locking device, for a heel portion of a safety ski binding, comprising:

a housing (24) for fastening to a ski (10), a retainer member (26) movably guided with respect to the housing (24) in a direction of contact pressure (A) against a ski boot (12), a support member (40) which is movable with respect to the housing (240, in a direction opposite to the contact pressure direction (A), form an inoperative position into a retracted position, a spring assembly (70) which rests on the support member (40) and loads the retainer member (26) in the contact pressure direction (A), at lest one locking member (50), normally in a locking position for keeping the support member (40) in the inoperative position, said at least one locking member being movable into a passing position for permitting movement of the support member (40) into the retracted position, a pawl (46) for normally keeping the locking member (50) in a locking position, and an electromagnet 960) including an armature (62) for moving along a magnet axis (B) against the pawl (46) to move the pawl (46) out of engagement and to unlock the locking member, thus permitting movement of the support member (40) into the retracted position, when a power circuit containing the electromagnet (60) is in a predetermined switching state, wherein the pawl (46) is supported for pivoting movement about a pivot axis (44) which extends transversely of and spaced form the magnet axis (B), and comprises a shoulder (48) which is spaced form the pivot axis (44) and normally presses against the locking member (50) in the locking position and wherein the angle between the pawl and the magnet axis (B), defines an angle within which self-locking takes place.

2. The locking device as claimed in claim 1, characterized in that the pivot axis (44) is disposed above the locking member (50) enabling the pawl (46) to swing, under the influence of its own weight, into a normal position in which the pawl keeps the locking member (50) in the locking position.

3. The locking device as claimed in claim 2 wherein the pawl (46) is biased elastically for pivoting into the normal position.

4. The locking device as claimed in claim 1, wherein the pawl (46) is supported on the support member (40) and is movable, upon release of the locking member (50), together with the locking member and the support member (40), in a direction opposite to the contact pressure direction (A).

5. The locking device as claimed in claim 1, wherein the electromagnet (60) is positioned between the retainer member (26) and the pawl (46), the magnet axis (B) extends parallel to the contact pressure direction (A), and the armature (62) is movable in a direction opposite to the direction of contact pressure (A), in the predetermined switching state.

6. An elastic locking device, for a heel portion of a safety ski binding, comprising: 'a housing (24) for fastening to a ski (10), a retainer member (26) movably guided with respect to the housing (24) in a direction of contact pressure (A) against a ski boot (12), a support member (40) which is movable with respect to the housing (24), in a direction opposite to the contact pressure direction (A), from an inoperative position into a retracted position, a spring assembly (70) which rests on the support member (40) and loads the retainer member (26) in the contact pressure direction (A), at least one locking member (50), normally in a locking position for keeping the support member (40) in the inoperative position, said at least one locking member being movable into a passing position for permitting movement of the support member (40) into the retracted position, a pawl (46) normally for keeping the locking member (50) in the locking position, and an electromagnet (60) including an armature (62) for moving along a magnet axis (B) against the pawl (46) to move the pawl (46) out of engagement and to unlock the locking member, thus permitting movement of the support member (40) into the retracted position, when a power circuit containing the electromagnet (60) is in a predetermined switching state, a hold-down member (30) for the ski boot (12), being supported at the retainer member (26) for movement between hold-down and release portions, and the spring assembly (70) biasing the hold-down member (30) in the direction of the hold-down position, wherein the retainer member (26) has an abutment surface (28) for the ski boot (12), and two switches (124, 126) each in the power circuit of the electromagnet activate the retainer member (26) and the hold-down member (30), respectively.

7. The locking device as claimed in claim 6, wherein the two switches (124, 126) in the circuit are connected in parallel.

8. The locking device as claimed in claim 7, wherein the two switches (124, 126) are each connected in series with a timer (132, 134).

9. The locking device as claimed in claim 6, wherein a respective one of two rods (102, 104) disposed at either side of the longitudinal median plane (18) of the locking device (20) cooperates with the retainer member (26) and the hold-down member (30), respectively, during actuation of the corresponding switch (124, 126).

10. The locking device as claimed in claim 9, wherein a cam (110, 112) is arranged on at least one of the rods (102, 104) for actuating the corresponding switch (124, 126) and is biased by a spring (114, 116) in the direction of a shoulder (118, 120) with which the rod (102, 104) is formed, a fixed stop (128, 130) in the housing preventing the cam from being displaced beyond the corresponding switch (124, 126).

* * * * *